US005205540A

United States Patent [19]

Clapp

[11] Patent Number: 5,205,540

[45] Date of Patent: Apr. 27, 1993

[54] TRIGGER VALVE ASSEMBLY

[75] Inventor: John M. Clapp, Sayre, Pa.

[73] Assignee: Ingersoll-Rand Company, Woodcliff Lake, N.J.

[21] Appl. No.: 853,231

[22] Filed: Mar. 16, 1992

[51] Int. Cl.[5] ..... F16K 31/00

[52] U.S. Cl. ..... 251/339; 239/526; 137/315

[58] Field of Search ..... 251/339, 244, 245, 246, 251/321; 239/526; 137/15, 315

[56] References Cited

U.S. PATENT DOCUMENTS

| | | | |
|---|---|---|---|
| 258,432 | 5/1882 | Keith | 251/321 |
| 1,470,111 | 10/1923 | Biersdorf | 239/526 |
| 2,598,417 | 5/1952 | Niemann | 251/321 |
| 2,657,098 | 10/1953 | Strahman | 239/526 |

*Primary Examiner*—A. Michael Chambers
*Attorney, Agent, or Firm*—Walter C. Vliet

[57] ABSTRACT

A trigger and valve assembly for a power tool and the like wherein the trigger stem is provided with an aperture for receiving and capturing a valve stem upon assembly of the tool components. The aperture further prevents removal of the trigger assembly upon assembly.

9 Claims, 2 Drawing Sheets

TRIGGER VALVE ASSEMBLY

BACKGROUND OF THE INVENTION

This invention relates generally to trigger valve assemblies for the initiation of operation of power tools and the like and more particularly to a means for establishing and securing cooperative action between a trigger device and a valving device in a pneumatic fluid operated power tool.

The prior art shows means for establishing cooperation between a trigger mechanism and the valve element, however, securing the operation between the two elements without resort to auxiliary clamping means would be a desirable feature and aid in assembly of the tool.

The foregoing illustrates limitations known to exist in present pneumatic operated power tools. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a trigger valve assembly comprising a finger operated actuator mounted in the tool for reciprocation along a longitudinal axis, the actuator being further provided with a projection along the longitudinal axis, a valve member disposed generally perpendicular to the longitudinal axis having an extended operating element thereof intercepting the projection of the actuator, the projection of the actuator being further provided with means for capturing the extended operating element upon initial insertion and operation of the actuator for selected displacement of the operating element and thereby the valve member to permit tool operation.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
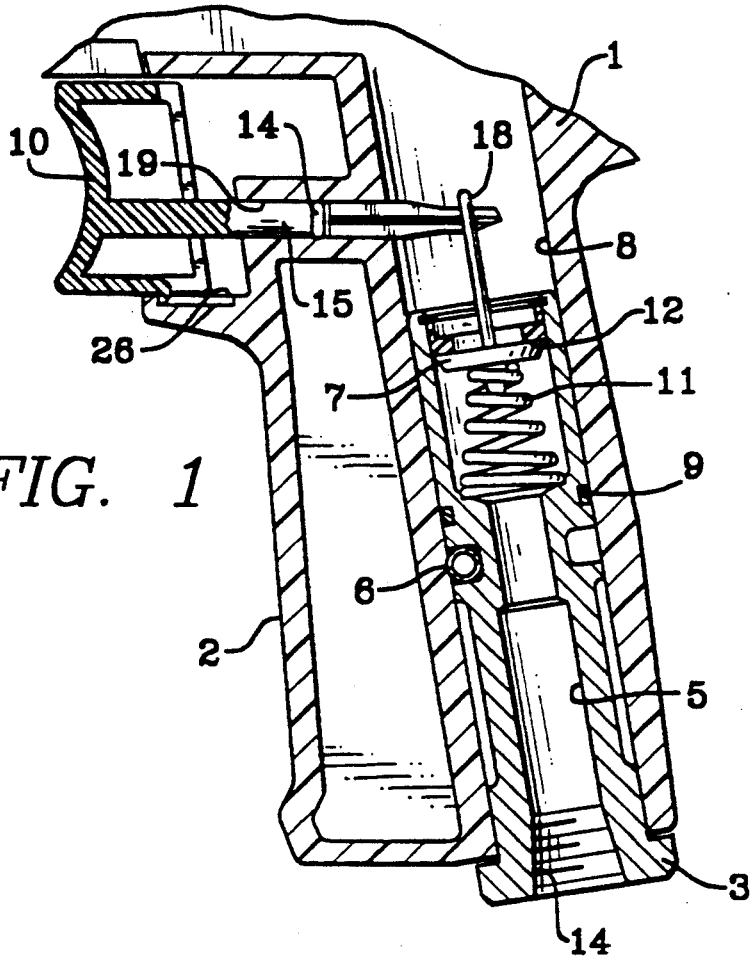
FIG. 1 shows a partial sectional view of a handle of a power tool or the like showing the trigger valve assembly according to the present invention with the valve in the closed position.

Referring to FIG. 1, the handle of a power tool is generally indicated by reference numeral 1. The handle is in the form of a pistol grip handle 2 having a hose connector 3 inserted in a bore within the handle 2. The connector 3 is provided with an air inlet 4 for receiving pneumatic pressure fluid which is distributed to the power tool through passageway 5 and a valve assembly. The connector is secured in the handle 2 by means of a retainer pin 6 and is sealed within a bore 8 by means of an "O" ring seal 9.

The valve assembly is comprised of a valve element 11 of the tilt valve or aerosol valve variety which is held against a valve seat 12 by means of a spring 11 and inlet air pressure. The valve element 7 is tilted in operation by means of a valve pin 18 which in turn is displaced by the trigger stem 15 associated with an operating trigger 10. The trigger 10 is reciprocally mounted in a trigger bore 19 and is sealed to prevent air flow along the bore by means of an "O" ring seal 14.

Figure 2:
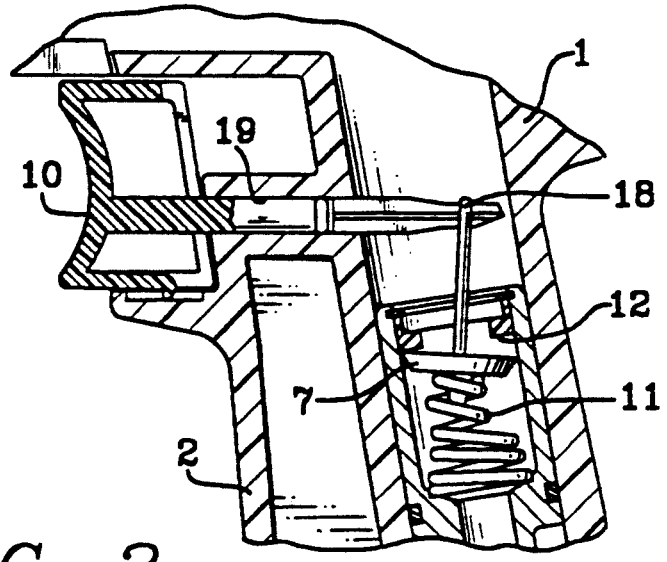
FIG. 2 shows the sequenced trigger depressed valve open position of the trigger valve assembly according to FIG. 1.

Referring to FIG. 2, the valve element 7 is shown progressively tilted to its open position, as progressively indicated by reference numerals 30, 31, 32, and 33 from the closed position to the open position, wherein the full open position as evidenced by reference numeral 33 corresponds to the fully depressed position of the trigger 10 as shown in FIG. 2.

Similar operation of the valve element is known in the prior art. However, in the past, operating contact of the trigger stem 15 with the valve pin 18 depended on a flat, or at best concave, forklike projection on the stem tip. According to the present invention a positive means of capturing the valve pin in the trigger valve stem tip is provided.

Figure 3:
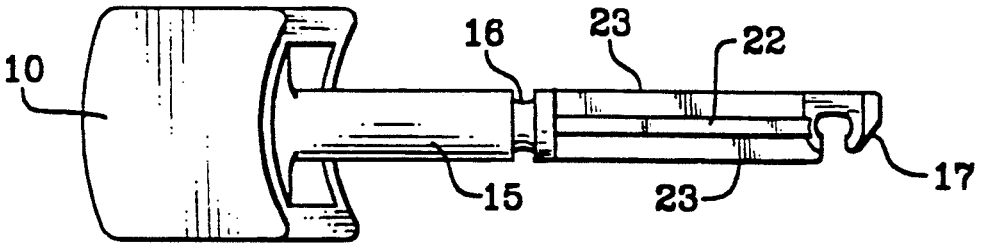
FIG. 3 is a plan view of the trigger according to the present invention.
Figure 4:
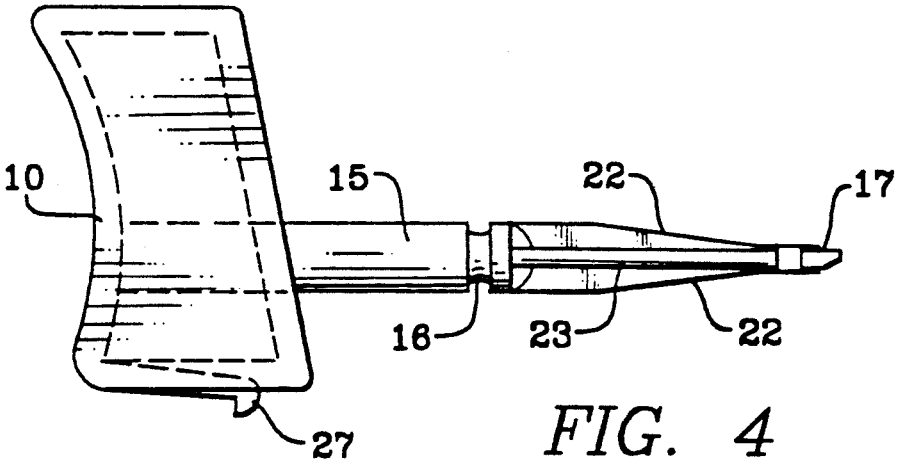
FIG. 4 is a side elevation view of the trigger according to the present invention.

Referring to FIG. 3, the general construction of the trigger 10 and attached trigger stem 15 is shown. The trigger stem 15 is of generally circular construction and is sealed in a trigger stem bore 19 by means of an "O" ring seal 14 placed in seal groove 16. Beyond the seal groove the structure of the trigger stem changes to a webbed cross section having a straight stiffener web 23 in the plan view of FIG. 3 and a tapered section web 22 as best seen in FIG. 4.

The trigger is prevented from rotating and is oriented by the generally rectangular shape of the trigger cooperating with the trigger pocket 26 (best seen in FIG. 1 or 2). The trigger stem is further provided with a unique stem tip 17, according to the present invention, as best shown in detail in FIG. 5. The stem tip 17 is provided with a guide surface 20, a capture slot 21 and an elongated capture hole 25 to accomplish the secure capture of the valve pin 18 during assembly of the tool and in further tool operation.

During assembly, the connector 3, including the valve assembly, is inserted in the bore 8 in the handle 2 to the position shown in FIG. 1. The trigger stem cross bore 19 intersects the centerline of the bore 8 and thus the trigger stem 15, when inserted in the bore 19, intersects the valve pin 18.

Figure 5:
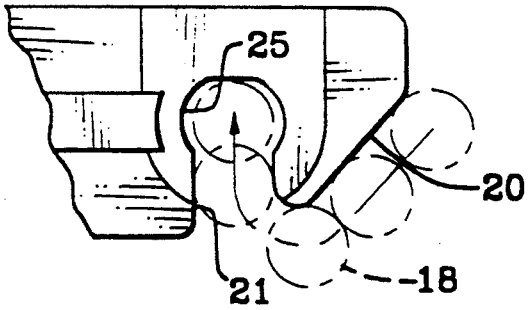
FIG. 5 is an enlarged detail of the tip of the trigger as shown in FIG. 3.

As shown progressively in FIG. 5, the valve pin 18 is deflected by guide surface 20 (downward as shown in FIG. 5) and subsequently, upon further insertion of the trigger and trigger stem, the valve pin will enter capture slot 21 and due to the action of spring 11 be forced to snap back into the elongated capture hole 25. The path is shown by the progression arrow on FIG. 5. The dimensions of the elongated capture hole 25 and the capture slot 21 are chosen so that the valve pin 18 is retained in the elongated capture hole positively except in one partially depressed position wherein the trigger stem and the valve pin are perpendicular to each other.

The valve pin 18, therefore, cannot escape the capture hole 25 except in a partially depressed trigger position and then only against the action of the spring 11 which is an extremely unlikely event. Capture slot 21 is of approximately the same width as the diameter of the valve pin 18 and guide surface 20 is positioned at an approximately 45 degree angle to the axis of the trigger stem 15 to provide convenient displacement of the valve pin during assembly. Separation of the valve pin from the trigger stem is accomplished readily only by the removal of the connector 3 longitudinally out of bore 8.

Figure 6:
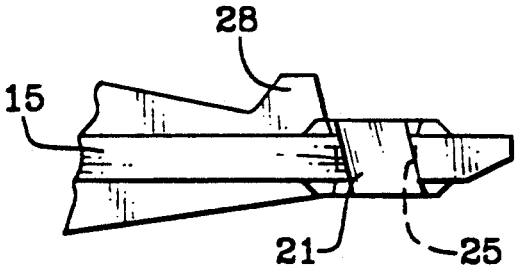
FIG. 6 is an enlarged detail of the tip of the trigger according to an alternate embodiment.

As shown in FIG. 6, which is an alternate embodiment of the present invention, the capture slot is shown angled slightly to the left from top to bottom so as to permit entry of the valve pin 18 during the valve closed position or approximate thereto as the one position for entry. In this embodiment the trigger stem 15 is provided with a vertical backing boss 28 which provides an added leverage surface to prevent withdrawal of the trigger stem once it has been captured in the capture slot 21 and seated in the elongated capture hole 25.

The capture slot may be utilized as a means of retention for the trigger 10 in the trigger stem bore 19. However, it has also been found convenient to provide the trigger with a snap catch means 27, as best seen in FIG. 4, which cooperates with a recess pocket or lip in handle 2, thereby providing added security against unwanted removal of the trigger.

Having described the invention, what is claimed is:

1. A trigger valve assembly for a power tool comprising:

a finger operated actuator mounted in said tool for reciprocation along a longitudinal axis;

said actuator being further provided with a projection along said longitudinal axis;

a valve member disposed generally perpendicular to said longitudinal axis having an extended operating element thereof intercepting said projection of said actuator;

said projection of said actuator being further provided with means for substantially capturing encircling, and securing thereto said extended operating element upon initial insertion and operation of said actuator for selected displacement of said operating element and thereby said valve member to permit tool operation wherein said means for capturing said extended operating element further comprises an aperture formed in said projection of said actuator for substantially encircling said operating element, and wherein said finger operated actuator projection is further provided with a means for deflecting and directing said extended operating element towards said means for capturing said extended operating element.

2. A trigger valve assembly according to claim 1, wherein said aperture is further provided with an access slot for receiving said operating element in only one selected operating position of said operating element.

3. A trigger valve assembly according to claim 2, wherein said one selected operating position corresponds to a partly depressed position of said finger operated actuator.

4. A trigger valve assembly according to claim 3, wherein said one selected operating position corresponds to a position wherein said finger operated actuator and said extended operating element are perpendicular to each other.

5. A trigger valve assembly according to claim 2, wherein said access slot is formed perpendicular to the longitudinal axis of said finger operated actuator in a plane perpendicular to the longitudinal axis of said extended operating element.

6. A trigger valve assembly according to claim 5, wherein said access slot has a width approximately equal to the width of the extended operating element.

7. A trigger valve assembly according to claim 2, wherein said one selected operating position corresponds to a valve seated position of said finger operated actuator.

8. A trigger valve assembly according to claim 2, wherein said aperture is provided with a backing means to prevent removal of said finger operated actuator once captured in said aperture.

9. A trigger valve assembly according to claim 1, wherein said means for deflecting and directing said extended operating element further comprises a deflecting surface disposed at the tip of said projection of said actuator at an angle of approximately 45 degrees to the longitudinal axis of said actuator.

* * * * *